US009129718B2

(12) United States Patent
Okamoto et al.

(10) Patent No.: US 9,129,718 B2
(45) Date of Patent: Sep. 8, 2015

(54) X-RAY WAVEGUIDE

(75) Inventors: Kohei Okamoto, Yokohama (JP); Atsushi Komoto, Moriya (JP); Wataru Kubo, Inagi (JP); Hirokatsu Miyata, Hadano (JP); Takashi Noma, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 79 days.

(21) Appl. No.: 13/820,072

(22) PCT Filed: Aug. 23, 2011

(86) PCT No.: PCT/JP2011/069369

§ 371 (c)(1),
(2), (4) Date: Feb. 28, 2013

(87) PCT Pub. No.: WO2012/029676

PCT Pub. Date: Mar. 8, 2012

(65) Prior Publication Data

US 2013/0163727 A1 Jun. 27, 2013

(30) Foreign Application Priority Data

Sep. 2, 2010 (JP) ..... 2010-196522

(51) Int. Cl.
*G21K 1/06* (2006.01)

(52) U.S. Cl.
CPC *G21K 1/06* (2013.01); *G21K 1/062* (2013.01); *G21K 2201/061* (2013.01)

(58) Field of Classification Search
CPC ..... G21K 1/06; G21K 1/062; G21K 1/067; G21K 2201/06; G21K 2201/061; G21K 2201/062; G21K 2201/067
See application file for complete search history.

(56) References Cited

U.S. PATENT DOCUMENTS 5,682,401 A * 10/1997 Joannopoulos et al. ..... 372/96
6,847,700 B1 * 1/2005 Mitra et al. ..... 378/145
7,266,284 B2 * 9/2007 Weiss et al. ..... 385/147

(Continued)

FOREIGN PATENT DOCUMENTS

CN 1668948 A 9/2005
JP 2012-014153 A 1/2012

OTHER PUBLICATIONS

Pfeiffer et al.,"X-ray waveguides with multiple guiding layers", Physical Review B, Dec. 2000, p. 16939-16943, vol. 62, No. 24.

(Continued)

*Primary Examiner* — Thomas R Artman
(74) *Attorney, Agent, or Firm* — Canon USA, Inc., IP Division

(57) ABSTRACT

A X-ray waveguide includes a core for guiding X-rays having a wavelength band in which the real part of refractive index of material is smaller than 1 and a cladding for confining the X-rays in the core. The core has a one-dimensional periodic structure in which a plurality of layers respectively formed of inorganic materials having different real parts of refractive index are periodically laminated. The core and the cladding are configured so that a critical angle for total reflection for the X-rays at an interface between the core and the cladding is larger than a Bragg angle due to a periodicity of the one-dimensional periodic structure. A critical angle for total reflection for the X-rays at an interface between layers in the one-dimensional periodic structure is smaller than the Bragg angle due to the periodicity of the one-dimensional periodic structure.

4 Claims, 12 Drawing Sheets

(56) References Cited

U.S. PATENT DOCUMENTS

| | | | | |
|---|---|---|---|---|
| 7,421,176 | B2 * | 9/2008 | Kittaka et al. | 385/129 |
| 7,715,677 | B2 * | 5/2010 | Helmy | 385/131 |
| 8,559,600 | B2 * | 10/2013 | Okamoto et al. | 378/145 |
| 8,611,503 | B2 * | 12/2013 | Okamoto et al. | 378/145 |
| 2011/0299661 | A1 * | 12/2011 | Okamoto et al. | 378/145 |
| 2011/0299662 | A1 * | 12/2011 | Okamoto et al. | 378/145 |
| 2012/0269327 | A1 * | 10/2012 | Okamoto et al. | 378/145 |
| 2012/0288055 | A1 * | 11/2012 | Komoto et al. | 378/36 |
| 2013/0039476 | A1 * | 2/2013 | Miyata et al. | 378/145 |
| 2013/0039477 | A1 * | 2/2013 | Okamoto et al. | 378/145 |
| 2013/0051534 | A1 * | 2/2013 | Okamoto et al. | 378/145 |
| 2013/0064352 | A1 * | 3/2013 | Kubo et al. | 378/145 |
| 2013/0142312 | A1 * | 6/2013 | Okamoto et al. | 378/145 |
| 2013/0156162 | A1 * | 6/2013 | Okamoto et al. | 378/145 |
| 2013/0163727 | A1 * | 6/2013 | Okamoto et al. | 378/145 |
| 2013/0177138 | A1 * | 7/2013 | Komoto et al. | 378/145 |
| 2013/0182827 | A1 * | 7/2013 | Okamoto et al. | 378/145 |

OTHER PUBLICATIONS

I.R.Prudnikov, "X-ray waveguides based on Bragg scattering of multilayers", Physical Review B, Jun. 2003, p. 233303—vol. 67, No. 23, p. 233303-1-233303-4.

Eberhard Spiller, Armin Segmüfler; "Propagation of x rays in waveguides"; Applied Physics Letters; vol. 24, p. 60-61 (1974).

A. Jarre, et al.; "X-ray waveguide nanostructures: Design, fabrication, and characterization"; Journal of Applied Physics; vol. 101, No. 5, 054306, pp. 054306-1 through 054306-6; Mar. 5, 2007.

* cited by examiner

X-RAY WAVEGUIDE

TECHNICAL FIELD

The present invention relates to an X-ray waveguide used in an X-ray optical system of an X-ray analysis technique, an X-ray imaging technique, an X-ray exposure technique, and the like.

BACKGROUND ART

When using an electromagnetic wave having a short wavelength of several tens of nm or less, a refractive index difference for the electromagnetic wave between different materials is very small, so the total reflection angle is very small. Therefore, to control electromagnetic waves including X-rays, a large-scale spatial optical system has been used, and is still mainly used. One of the main components included in the spatial optical system is a multilayer film reflecting mirror in which materials having different refractive indices are alternately laminated. The multilayer film reflecting mirror has various functions such as beam shaping, spot size conversion, and wavelength selection.

Different from such a spatial optical system which is mainly used, a conventional X-ray waveguide tube such as a poly-capillary confines X-rays in the tube and propagates the X-rays. In recent years, an X-ray waveguide is studied, which confines electromagnetic waves in a thin film or a multilayer film and propagates the electromagnetic waves, in order to downsize and enhance the optical system. Specifically, a thin film waveguide is reported in which a guiding layer is sandwiched by a two-layer one-dimensional periodic structure (see NPL 2). Further, an X-ray waveguide is reported in which a plurality of thin film X-ray waveguides that confine X-rays by total reflection are laminated and disposed (see NPL 1).

CITATION LIST

Non Patent Literature

NPL 1 Physical Review B, Volume 62, Number 24, p. 16939 (2000-II)

NPL 2 Physical Review B, Volume 67, Number 23, p. 233303 (2003)

SUMMARY OF INVENTION

Technical Problem

However, in NPL 1, as a cladding material of each waveguide, Ni, which has small imaginary part of the refractive index and large real part of the refractive index, is used in order to confine X-rays in each laminated waveguide consisting of single guiding layer by total reflection. Therefore, in NPL 1, X-ray propagation loss increases in each cladding. Further, waveguide mode coupling occurs between adjacent waveguides, and thereby many coupled modes are formed in the entire waveguide. Thus there is a problem that a single waveguide mode is difficult to be excited.

On the other hand, in NPL 2, an X-ray waveguide is proposed in which X-rays are confined in a core by Bragg reflection of a multilayer film provided as cladding. However, the multilayer film is formed of Ni and C, and a metal material absorbing a large amount of X-rays is used in many layers, so that a large absorption loss of X-rays occurs in the multilayer film. Further, there is a problem that a multilayer film having a very large number of layers needs to be used as cladding in order to confine X-rays in a core by Bragg reflection of the multilayer film as described in the above example.

The present invention is made in view of the above background art, and provides an X-ray waveguide in which a propagation loss of X-rays is small and a specific single waveguide mode can be selectively excited.

Solution to Problem

The present invention provides an X-ray waveguide including a core for guiding X-rays having a wavelength band in which the real part of refractive index of material is smaller than 1 and a cladding for confining the X-rays in the core. The core has a one-dimensional periodic structure in which a plurality of layers respectively formed of inorganic materials having different real parts of refractive index are periodically laminated. The core and the cladding are configured so that a critical angle for total reflection for the X-rays at an interface between the core and the cladding is larger than a Bragg angle due to a periodicity of the one-dimensional periodic structure. A critical angle for total reflection for the X-rays at an interface between layers in the periodic structure is smaller than the Bragg angle due to the periodicity of the periodic structure.

Advantageous Effects of Invention

According to the present invention, it is possible to provide an X-ray waveguide in which a propagation loss of X-rays is small and a single waveguide mode in phase over the cross section area normal to the direction of propagation constant can be selectively excited.

DESCRIPTION OF EMBODIMENTS

Figure 1:
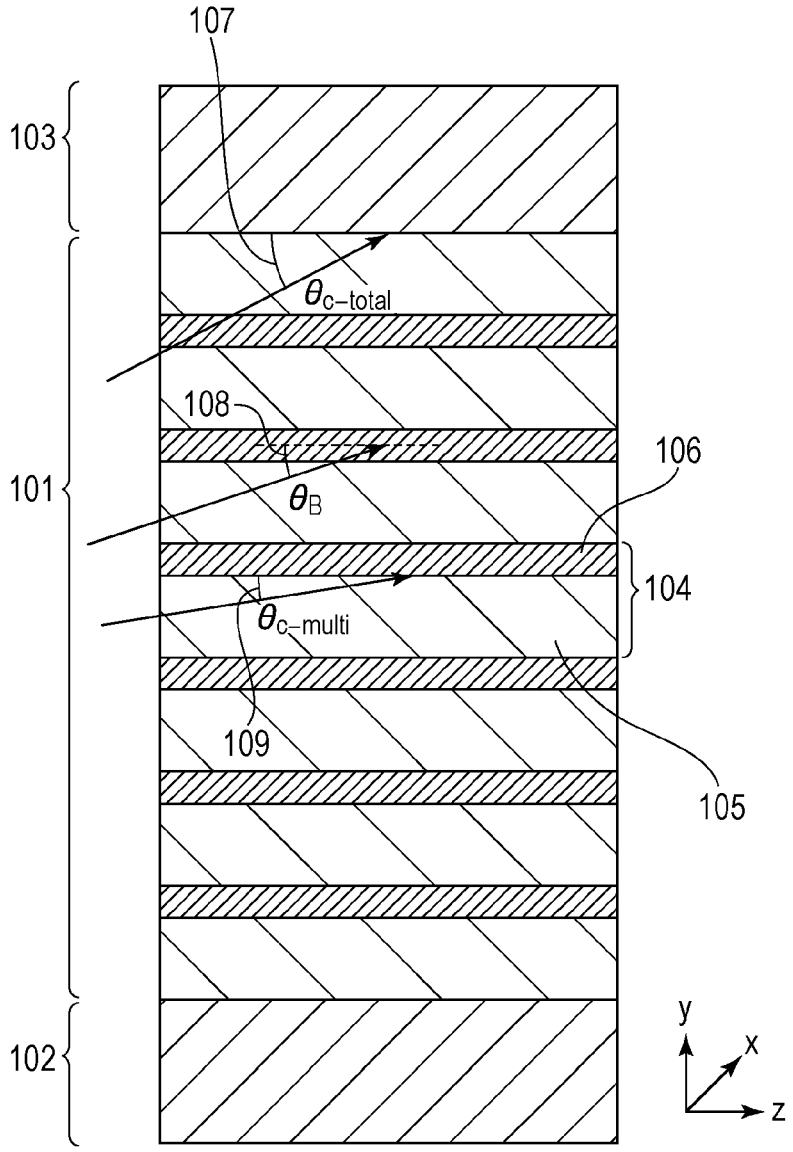
FIG. 1 is a schematic diagram showing an aspect of an X-ray waveguide of the present invention.

Hereinafter, the present invention will be described in detail.

In the present invention, an X-ray means an electromagnetic wave in a wavelength band in which the real part of the refractive index of material is smaller than 1. Specifically, in the present invention, the X-ray indicates an electromagnetic wave having a wavelength of 100 nanometer or less including extreme ultraviolet (EUV) light. The present invention is to control an electromagnetic wave corresponding to the above-described X-ray. Hereinafter, in this description, the term electromagnetic wave is used synonymously with the X-ray. The frequency of an electromagnetic wave having such a short wavelength is very high, and outermost electron of matter cannot respond. Therefore, it is known that, different from a frequency band of electromagnetic waves (visible light and infrared light) having a wavelength longer than that of ultraviolet light, the real part of the refractive index of materials for X-rays is smaller than 1. Such a refractive index n of materials for X-rays is generally represented by using a decrement δ from 1 of the real part and the imaginary part β' related to absorption as shown in the following formula (1).

$$n=1-\delta-i\beta'=n'-i\beta' \quad (1)$$

As δ is proportional to the electron density $\rho_e$ of a material, the larger the electron density of the material is, the smaller the real part of the refractive index is. The real part of the refractive index n' is 1−δ. Further, the electron density $\rho_e$ is proportional to the atom density $\rho_a$ and the atomic number Z. In this way, the refractive index of materials for X-rays is represented by a complex number. In this description, the real part n' is referred to as real part of refractive index and the imaginary part β' is referred to as imaginary part of refractive index.

When an electromagnetic wave corresponding to the above X-ray propagates in a vacuum, the real part of refractive index for the electromagnetic wave is the largest. In this description, the term material is also applied to vacuum. Only when the material is a complete vacuum, the real part of refractive index of the material is 1. In the present invention, in many cases, two or more inorganic materials having different real parts of refractive index are two or more inorganic materials having different electron densities.

In the present invention, the above-described core is formed with a one-dimensional periodic structure in which a plurality of layers formed of inorganic materials having different real parts of refractive index are periodically laminated in a one-dimensional direction in a direction perpendicular to the guiding direction. In this description, the guiding direction is parallel to the direction of the propagation constant of each waveguide mode. In the present invention, the core material is formed of inorganic materials having a one-dimensional periodic structure, and thereby the core can be manufactured by an established process such as conventional sputtering, vapor deposition, or crystal growth, and the core can have a structure resistant to heat and external force.

The inorganic materials having different real parts of refractive index, which form the core, can be at least two materials selected from the group consisting of Be, B, C, $B_4C$, BN, SiC, $Si_3N_4$, SiN, $Al_2O_3$, MgO, $TiO_2$, $SiO_2$, and P.

The material forming the cladding can be at least one material selected from the group consisting of Au, W, Ta, Pt, Ir, and Os.

Next, total reflection confinement in the present invention will be described. The X-ray waveguide of the present invention confines X-rays in a core which is a multilayer film having a one-dimensional periodic structure by total reflection on the interface between the core and cladding to form waveguide mode, and propagates the X-rays. FIG. 1 is a schematic diagram showing an aspect of the X-ray waveguide of the present invention. In FIG. 1, the X-ray waveguide of the present invention includes a core for waveguiding an electromagnetic wave in a wavelength band in which the real part of the refractive index of material is smaller than 1 and a cladding for confining the electromagnetic wave in the core. A core 101 is sandwiched between a cladding 102 and a cladding 103. The core 101 is formed with a one-dimensional periodic structure in which a plurality of layers formed of inorganic materials having different real parts of refractive index are periodically laminated in a one-dimensional direction in a direction perpendicular to the propagation direction. Specifically, in the core 101, unit structures 104 including a material layer 106 having a small real part of refractive index and a material layer 105 having a large real part of refractive index are laminated in a one-dimensional direction. This is the one-dimensional periodic structure, which is a multilayer film having a periodic refractive index distribution. In other words, in the one-dimensional periodic structure, unit structures 104 including at least two layers respectively formed of inorganic materials having different real parts of refractive index are laminated by using the unit structure 104 as a unit.

In FIG. 1, a critical angle for total reflection $\theta_{c\text{-}total}$ 107 at the interface between the cladding and the core is shown. A critical angle for total reflection $\theta_{c\text{-}multi}$ 109 at the interface between the material layer having a large real part of refractive index and the material layer having a small real part of refractive index, which form the unit structure in the multilayer film, is shown. A Bragg angle $\theta_B$ 108 corresponding to periodicity of the multilayer film is shown. In this description, these angles are measured with respect to a direction in parallel with a surface of the film (a direction in parallel with z-x plane). The arrows in FIG. 1 indicate an example of traveling directions of X-rays.

When the real part of refractive index of a material of the cladding at the interface between the cladding and the core is $n_{clad}$, the real part of refractive index of a material of the core is $n_{core}$, and $n_{clad}<n_{core}$, a critical angle for total reflection $\theta_{c\text{-}total}$ (°) with respect to a direction in parallel with a surface of the film is represented by the following formula.

[Math. 1]

$$\theta_{c\text{-}total} = \frac{180}{\pi}\arccos\left(\frac{n_{clad}}{n_{core}}\right) \quad (2)$$

Actually, the layers are very thin, so the real parts of refractive indices of the layers are somewhat different from the real part of refractive index of bulk materials. However, the real parts of refractive indices of the layers can be described using effective refractive indices. When a period of the multilayer film of the core is d and an average real part of refractive index of the multilayer film of the core is $n_{avg}$, the Bragg angle $\theta_B$ (°) in an approximate periodic structure is defined by the formula (3) below regardless of presence or absence of multiple diffraction in the core.

[Math. 2]

$$\theta_B \approx \frac{180}{\pi}\arcsin\left(\frac{1}{n_{avg}}m\frac{\lambda}{2d}\right) \quad (3)$$

Here, m is a natural number and λ is the wavelength of the X-rays.

It is assumed that physical parameters of the material included in the X-ray waveguide of the present invention, structural parameters of the waveguide, and the wavelength of the X-rays are designed so that the formula (4) is satisfied.

$$\theta_B<\theta_{c\text{-}total} \tag{4}$$

This means that the critical angle for total reflection $\theta_{c\text{-}total}$ at the interface between the core and the cladding is greater than the Bragg angle $\theta_B$ of the multilayer film of the core with respect the X-rays. In other words, the Bragg angle $\theta_B$ of the multilayer film of the core with respect the X-rays is smaller than the critical angle for total reflection $\theta_{c\text{-}total}$ at the interface between the core and the cladding. By this condition, a waveguide mode having an effective propagation angle near the Bragg angle attributable to the one-dimensional periodicity of the multilayer film of the core can be always confined in the core by the total reflection at the interface between the cladding and the core, so the propagation of the X-rays can be facilitated. Here, the effective propagation angle θ'(°) is an angle measured from a direction in parallel with a surface of the film, and represented by the formula (5) using a wave vector (propagation constant) $k_z$ in the propagation direction of the waveguide mode and a wave vector $k_0$ in a vacuum.

[Math. 3]

$$\theta' = \frac{180}{\pi}\arccos\left(\frac{k_z}{k_0}\right) \tag{5}$$

Figure 2:
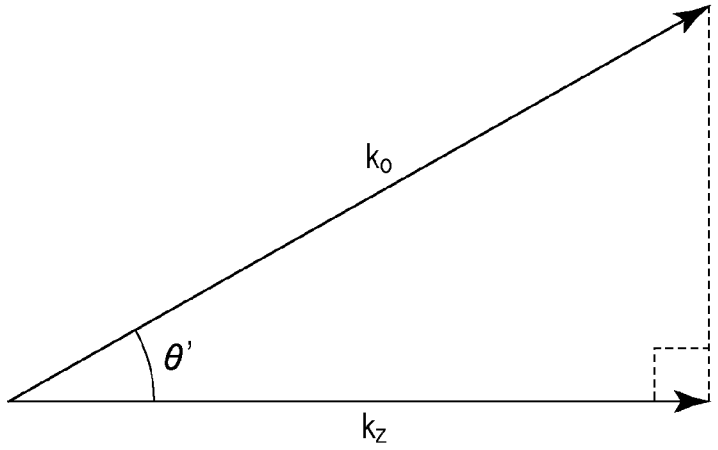
FIG. 2 is a diagram for explaining a definition of effective propagation angle.

Because of the continuity condition of an electromagnetic wave on an interface, $k_z$ is constant on the interfaces of the layers, so as shown in FIG. 2, the effective propagation angle θ'(°) is an angle between the propagation constant $k_z$ of a fundamental wave of the waveguide mode and the wave vector $k_0$ in a vacuum. It can be considered that the effective propagation angle θ'(°) approximately represents the propagation angle of the fundamental wave of the waveguide mode in the core. In FIG. 2, for ease of explanation, θ'(°) is emphatically shown by using a large angle, however, in many cases, θ'(°) is actually a small angle of 1° or less in the X-ray waveguide of the present invention.

Further, the multilayer film of the core of the present invention is formed by laminating films of a plurality of types of materials having different real parts of refractive index in a one-dimensional periodic structure, and there is a critical angle for total reflection at an interface between films adjacent to each other in the multilayer film of the core due to a difference between the real parts of refractive index. When there are three or more types of materials having different real parts of refractive index in the multilayer film, there may be a plurality of critical angle for total reflections. The largest one of the critical angles for total reflection is defined as $\theta_{c\text{-}multi}$ (°).

$$\theta_{C\text{-}multi}<\theta_B \tag{6}$$

As shown in formula (6), when the critical angle for total reflection $\theta_{C\text{-}multi}$ in the multilayer film is smaller than the Bragg angle $\theta_B$ attributable to the periodicity of the multilayer film, an X-ray inputted to the interface in the multilayer film at an angle larger than an angle near the Bragg angle is not totally reflected but partially reflected or refracted. The multilayer film has a structure in which a plurality of layers having different real parts of refractive index are periodically laminated, so there are a plurality of interfaces arranged periodically in the laminating direction, and X-rays in the multilayer film are repeatedly reflected and refracted at the interfaces. The multilayer film of the present invention has a periodic structure, so such repetition of reflection and refraction of X-rays inside the multilayer film cause multiple interference. As a result, X-rays having a condition capable of resonating with the periodic structure of the multilayer film, that is, propagation modes that can be present in the multilayer film, is formed. These propagation modes are confined in the core by the total reflection at the interface between the cladding and the core, and a waveguide mode is formed in the core. The effective propagation angle θ' of the waveguide mode appears near the Bragg angle $\theta_B$ of the multilayer film.

Since the waveguide mode is a mode resonating with the periodicity of the periodic structure, the waveguide mode is referred to as a periodic resonant waveguide mode in this description.

In the same way as a crystal of a semiconductor or the like forms a band for electrons and holes inside the crystal, a refractive index periodic structure forms a band representing a dispersion relation between energy and wave vector of an electromagnetic wave for the electromagnetic wave. This is called photonic band. A graph of this relation is referred to as a photonic band structure or a photonic band diagram. An electromagnetic wave having a wave vector and energy corresponding to the photonic band can be present in the structure. However, an electromagnetic wave corresponding to specific wave vector and energy may not be able to be present due to a type of the periodic structure or the like. This appears as an area in which no band is present in the photonic band structure, and the area is called photonic band gap. Bragg reflection on a simple periodic structure corresponds to a phenomenon in which an electromagnetic wave corresponding to a photonic band gap cannot present in a periodic structure and reflected.

In an actual multilayer film, the number of periods is finite, so the photonic band structure of the multilayer film is shifted from a photonic band structure of a multilayer film having an unlimited number of periods. However, as the number of periods in the multilayer film increases, the characteristics of the waveguide mode approach the characteristics of the photonic band structure having an infinite number of periods. As described above, the Bragg reflection corresponds to a photonic band gap due to periodicity. This is because, when considering the effective propagation angle of the waveguide mode assuming that energy of the X-rays is constant, a waveguide mode having the effective propagation angle θ'(°) near an angle corresponding to an angle of an edge of photonic band gap is formed when the edge of photonic band gap is seen an angle. The edge of photonic band gap is called photonic band edge. This is, what we call, the periodic resonant waveguide mode. In a spatial distribution of electric field intensity of the periodic resonant waveguide mode, the electric field intensity tends to be concentrated into a material in which propagation loss is small in the multilayer film having a periodic structure. Further, an envelope curve of the electric field intensity distribution has a shape biased toward the center of the core, and a propagation loss due to leakage to the cladding tends to decrease. In the present invention, a state that the waveguide mode is in phase in the direction normal to the guiding direction is a concept including not only a case in which there is no phase difference in the electromagnetic field in a plane perpendicular to the guiding direction, but also a case in which the phase difference of the electromagnetic field periodically fluctuates between −π and +π corresponding to a spatial refractive index distribution in the periodic structure. In the periodic resonant waveguide mode in the present invention, the phase of the electric field oscillates between $-\pi$ and $+\pi$ at the same period as that of the periodic structure in a direction perpendicular to the guiding direction.

In such a multilayer film, there may be a waveguide mode having an angle other than the effective propagation angle included in the periodic resonant waveguide mode described above. This waveguide mode is present when the entire multilayer film of the core is assumed to be a uniform medium in which the real parts of refractive index are averaged. The waveguide mode is not a waveguide mode resonating with the periodicity of the multilayer film. The waveguide mode is referred to as uniform waveguide mode to differentiate from the periodic resonant waveguide mode. In the periodic resonant waveguide mode, as the number of the periods of the periodic structure increases, the amount of leakage to the cladding decreases and the electric field intensity tends to concentrate in a low loss material, and thereby there is an effect that the propagation loss of the X-rays decreases. Further, although depending on the structure and the material of the waveguide, the propagation loss in the periodic resonant waveguide mode is obviously smaller than that in the uniform waveguide mode having the effective propagation angle similar to that of the periodic resonant waveguide mode. Specifically, while the X-rays are propagated in the waveguide, the periodic resonant waveguide mode is being selected as a waveguide mode in the waveguide structure, and the periodic resonant waveguide mode most strongly contributes to the waveguiding of the X-rays. Basically, the periodic resonant waveguide mode has an effective propagation angle near the Bragg angle. Therefore, by the configuration of the X-ray waveguide of the present invention, it is possible to realize propagation of X-rays by a single waveguide mode, which is the periodic resonant waveguide mode. Such an effect and advantage become more obvious as the number of periods of the periodic structure increases. Generally, to form a single uniform waveguide mode, the core needs to be very small so that a single mode condition of the waveguide is satisfied. However, in the X-ray waveguide of the present invention, it is possible to realize a substantial single waveguide mode by using a thick core having a large number of periods. Although depending on the refractive index of the material, the number of periods in the periodic structure of the core of the X-ray waveguide in the present invention is preferable to be 20 or more, and more preferable to be 40 or more.

Figure 3:
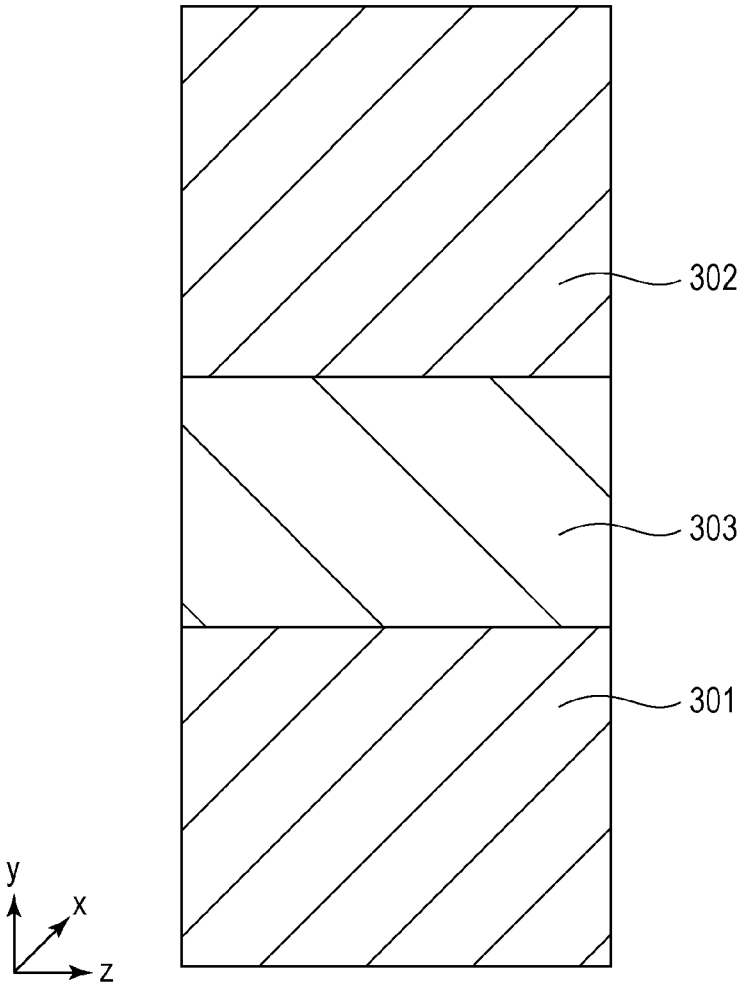
FIG. 3 is a schematic diagram showing another aspect of an X-ray waveguide of the present invention.

FIG. 3 is a schematic diagram showing another aspect of the X-ray waveguide of the present invention. The X-ray waveguide shown in FIG. 3 has a configuration in which a core 303 is sandwiched between a cladding 301 and a cladding 302. Therefore, X-rays are confined in the core by total reflection at the interface between the cladding and the core.

The core 303 is a multilayer film in which carbon (C) having a thickness of about 11.2 nanometer and aluminum oxide ($Al_2O_3$) having a thickness of about 2.8 nanometer are alternately laminated 25 times in a one-dimensional periodic structure by, for example, sputtering. Further, a layer of carbon (C) is added so that materials that are in contact with two interfaces between the core and the cladding are carbon (C) having a large real part of refractive index. Therefore, carbon (C) is in contact with the cladding at the two interfaces between the core and the cladding. One period (thickness of a unit structure including C and $Al_2O_3$) is about 14 nanometer. Gold (Au) is used as the claddings 301 and 302.

A critical angle for total reflection $\theta_{C\text{-}multi}$ at interfaces between layers in the multilayer film of the core, that is, at interfaces between C and $Al_2O_3$, for an X-ray whose photon energy is 8 kilo-electron-volt, is about 0.19°. The Bragg angle $\theta_B$ due to the periodicity of the core is about 0.39°. Therefore, the condition of the above-described formula (6) is satisfied and X-rays having a propagation angle near the Bragg angle can cause multiple interference. Thus a propagation mode having a propagation angle θ' near the Bragg angle can be formed.

If the materials of the core being in contact with the claddings 301 and 302 are C, the critical angle for total reflection $\theta_{c\text{-}total}$ at the interface between the cladding and the core is about 0.55°. The Bragg angle $\theta_B$ due to the periodicity of the core is about 0.39°. Therefore, the condition of the above-described formula (4) is satisfied. Hence, the propagation mode having the propagation angle θ' near the Bragg angle $\theta_B$ can be confined in the core by total reflection at the interface between the cladding and the core. This confined propagation mode is the periodic resonant waveguide mode having the effective propagation angle θ'.

Figure 4:
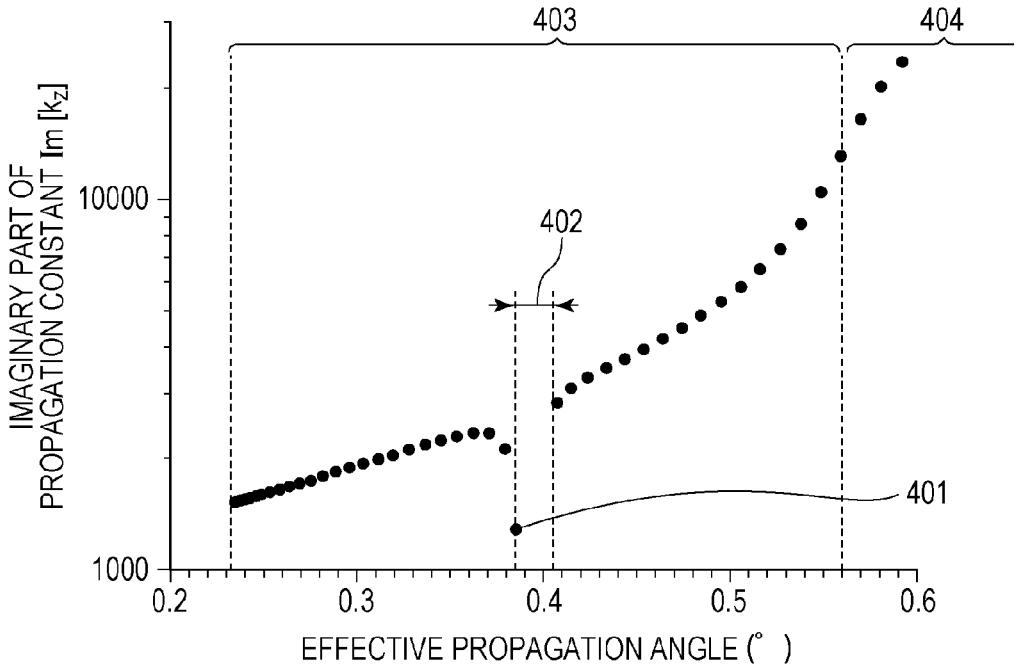
FIG. 4 is a diagram showing a dependency on the effective propagation angle of a loss of waveguide mode (imaginary part of propagation constant).

As for the X-ray waveguide in FIG. 3, a relationship between the effective propagation angle θ' and the imaginary part Im [$k_z$] of the propagation constant $k_z$ in a waveguide mode formed in the core for an X-ray whose photon energy is 8 kilo-electron-volt is obtained by a numerical calculation. The result is shown in FIG. 4. In FIG. 4, the horizontal axis indicates the effective propagation angle θ' and the vertical axis indicates the imaginary part Im [$k_z$] of the propagation constant. The imaginary part of the propagation constant is related to attenuation of the waveguide mode, and relates to a propagation loss of the waveguide mode. Therefore, it is considered that FIG. 4 shows dependency on the effective propagation angle of a loss of waveguide mode contributing to the propagation. In FIG. 4, an angle corresponding to the boundary between areas 403 and 404 is the critical angle for total reflection $\theta_{c\text{-}total}$ at the interface between the core and the cladding. The propagation mode in the angle area 403 smaller than the critical angle for total reflection $\theta_{c\text{-}total}$ represents the waveguide mode confined in the core by the total reflection at the interface between the cladding and the core. The propagation mode in the angle area 404 larger than the critical angle for total reflection $\theta_{c\text{-}total}$ is the angle area of a radiation mode which cannot be confined in the core by the total reflection at the interface between the cladding and the core and in which the loss is large. The area 402 is an area corresponding to the Bragg reflection due to the periodicity of the multilayer film, that is, an area corresponding to the photonic band gap. In the area, X-rays cannot be present in the structure, so there is no propagation mode in the angle area.

In the area 403 including an effective propagation angle smaller than the critical angle for total reflection $\theta_{c\text{-}total}$, reference numeral 401 denotes a point indicating the loss and the effective propagation angle of the periodic resonant waveguide mode. It is found that the loss is significantly smaller than that of other waveguide modes having an effective propagation angle near the Bragg angle. Here, the critical angle for total reflection $\theta_{c\text{-}total}$ and an angle near the Bragg angle $\theta_B$ obtained from FIG. 4 are different from the critical angle for total reflection and the Bragg angle roughly estimated from the formulas (2) and (3). This is because lengths of optical paths and the like are different from those in the actual structure due to leakage of X-rays and complex interferences.

Figure 5:
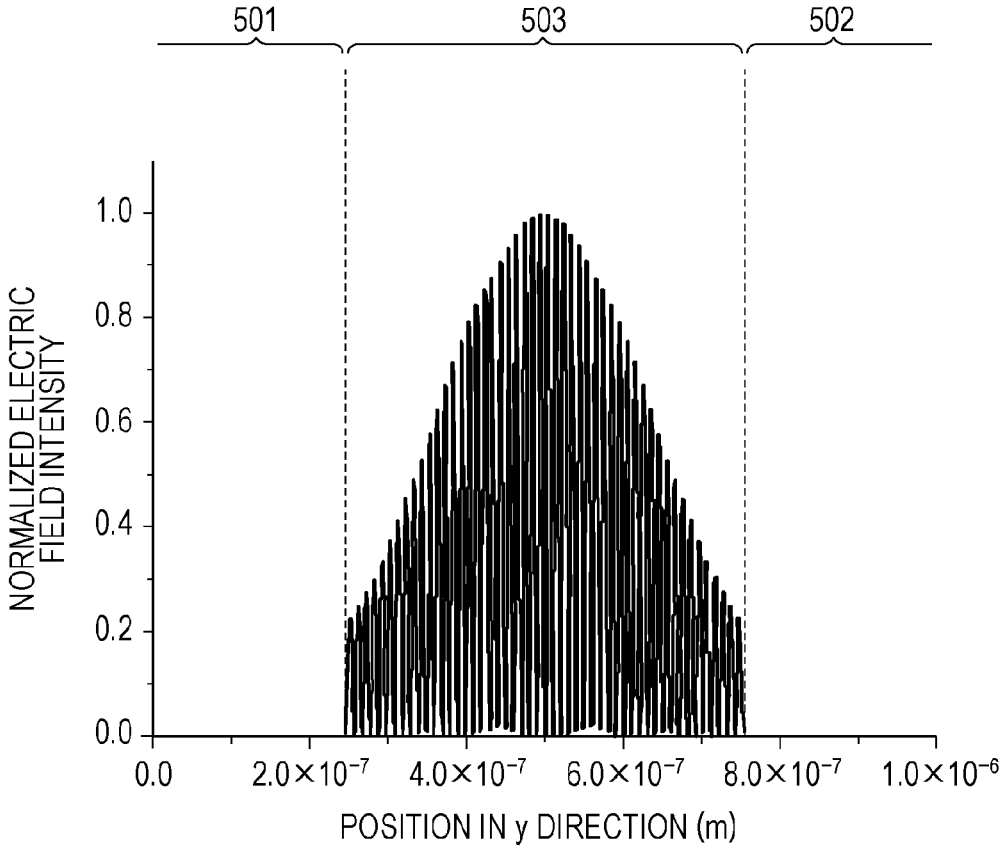
FIG. 5 is a diagram showing an electric field intensity distribution of periodic resonant waveguide mode.

FIG. 5 shows an example of a spatial electric field intensity distribution of the periodic resonant waveguide mode of a multilayer film having 50 periods. By receiving influence of the periodicity in the multilayer film, the entire electric field intensity distribution is biased toward the center of the core and the amount of X-rays leaking into the cladding decreases, so that it is possible to reduce the propagation loss. On the other hand, in a core that is a uniform film having no periodicity, the envelope curve of electric field intensity distribution is substantially flat. In FIG. 5, the horizontal axis indicates a position in a direction perpendicular to the surface of the film, that is, the y direction, reference numerals 501 and 502 denote portions corresponding to the claddings, and reference numeral 503 denotes a portion corresponding to the core. From the electric field intensity distribution of the periodic resonant waveguide mode, it is found that the number of the local maximum values of the electric field intensity corresponds to the number of the periods in the periodic structure, the electric field concentrates into a portion of a material having a large real part of refractive index and small absorption, and the propagation loss becomes small. On the other hand, in FIG. 4, the propagation loss of other waveguide modes having an effective propagation angle near the effective propagation angle of the periodic resonant waveguide mode 401 is obviously larger than that of the periodic resonant waveguide mode. Therefore, the periodic resonant waveguide mode 401 is clearly distinctive from other uniform waveguide modes and becomes more effective for propagating X-rays with less loss. In other waveguide modes near the effective propagation angle of the periodic resonant waveguide mode, the periodic resonant waveguide mode is dominant, and X-rays can be guided by the periodic resonant waveguide mode that is substantially a single waveguide mode.

First Embodiment

Figure 6:
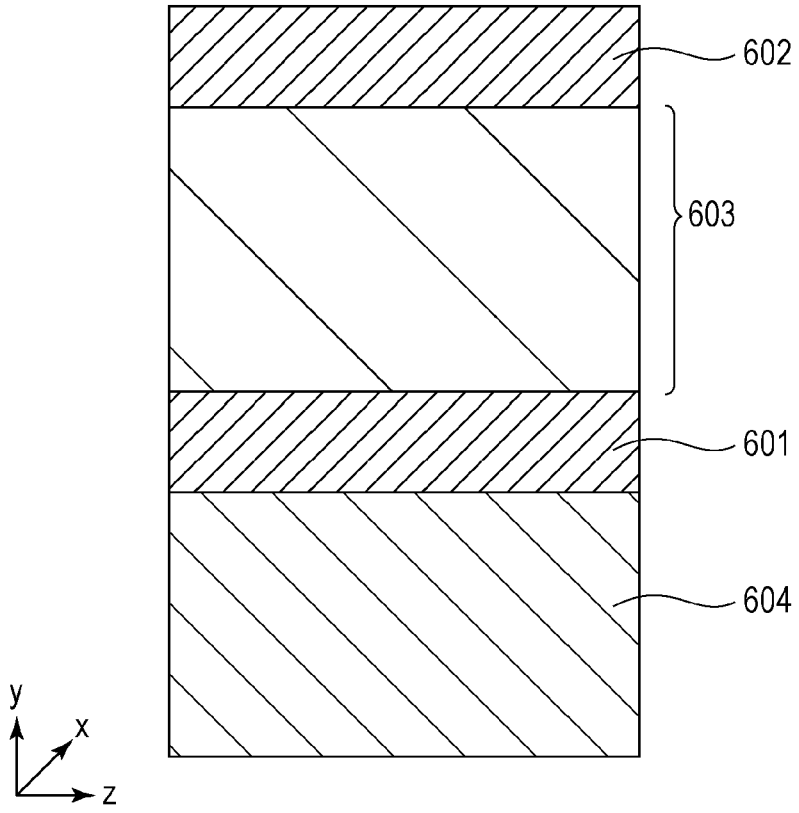
FIG. 6 is a diagram showing an X-ray waveguide of a first embodiment of the present invention.

FIG. 6 is a diagram showing an X-ray waveguide of a first embodiment of the present invention. In FIG. 6, the guiding direction of X-rays is the z direction. On an Si substrate 604, a lower cladding 601 made of tungsten (W) having a thickness of 20 nanometer, a multilayer film 603 having a one-dimensional periodic structure, and an upper cladding 602 made of tungsten (W) having a thickness of 20 nanometer are formed by a sputtering method. The multilayer film 603 has a periodic structure in which a film made of carbon (C) having a thickness of 12 nanometer and a film made of aluminum oxide ($Al_2O_3$) having a thickness of 4 nanometer are alternately laminated. The number of the periods is 50 and the period is 16 nanometer. Actually, the uppermost portion and the lowermost portion of the core is made of a film of aluminum oxide ($Al_2O_3$) having a low real part of refractive index. The critical angle for total reflection at the interface between the cladding and the core for an X-ray having a photon energy of 8 kilo-electron-volt is about 0.51°. The critical angle for total reflection at the interface between the aluminum oxide and the carbon that form the periodic structure in the multilayer film is about 0.19°. The Bragg angle due to the periodicity of the multilayer film is about 0.28°. Therefore, the configuration satisfies the above-described formulas (4) and (6).

Figure 7:
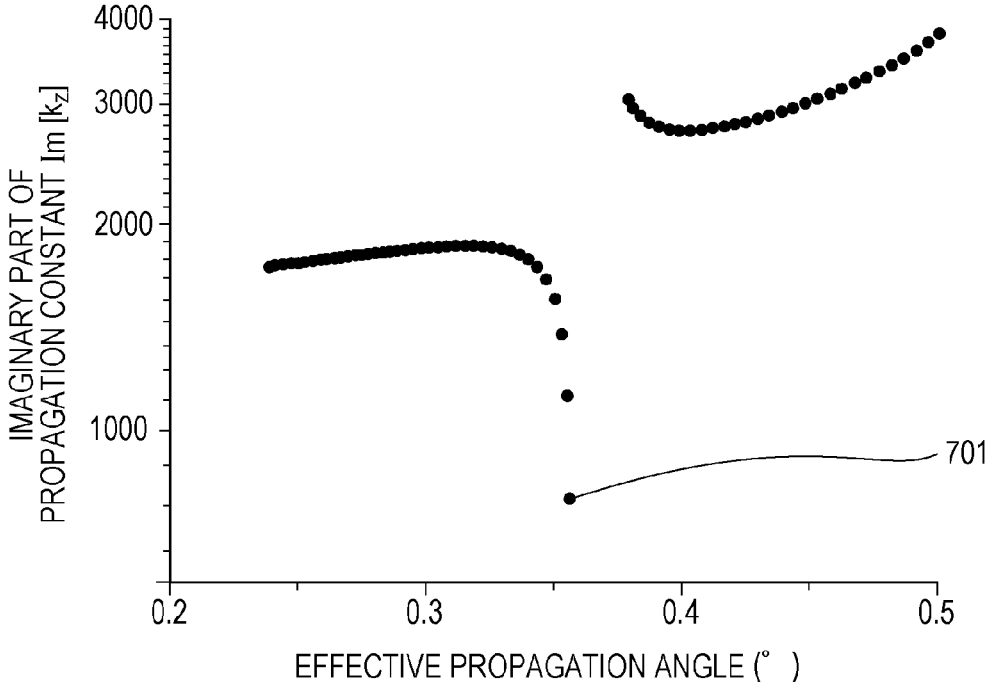
FIG. 7 is a diagram showing a dependency on the effective propagation angle of a loss of waveguide mode in the X-ray waveguide of the first embodiment of the present invention.
Figure 8:
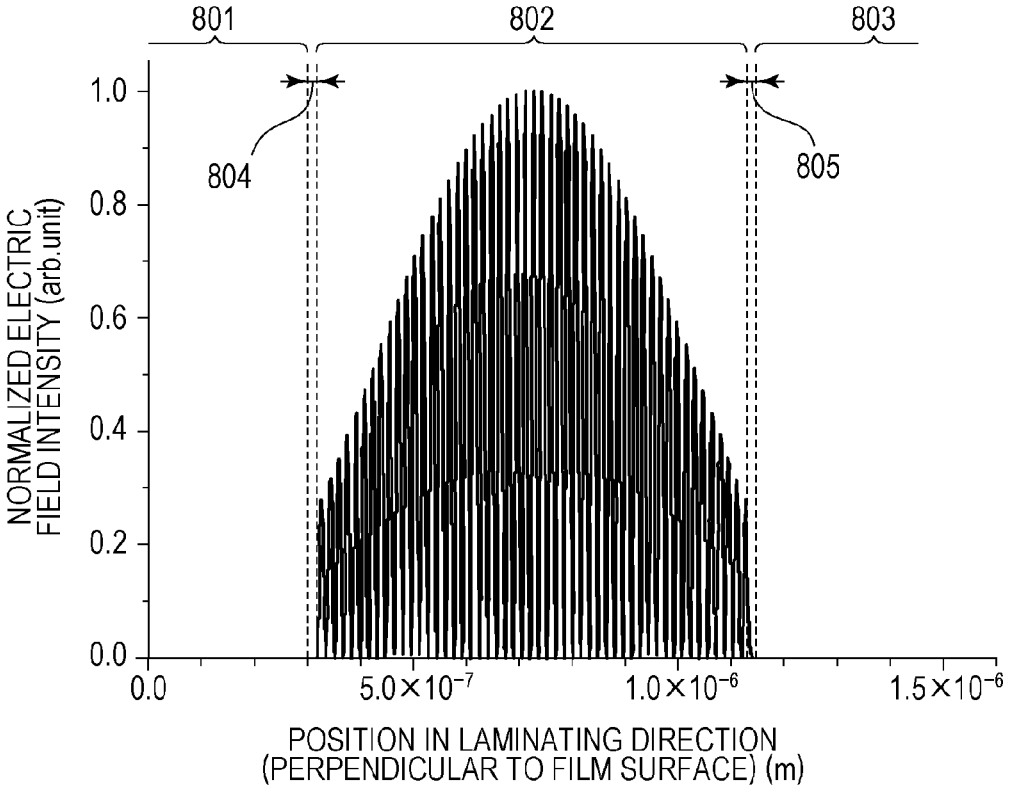
FIG. 8 is a diagram showing an electric field intensity distribution of periodic resonant mode in the X-ray waveguide of the first embodiment of the present invention.

FIG. 7 is a graph obtained by calculating the propagation loss (the imaginary part of the propagation constant) of a waveguide mode present in the X-ray waveguide of the present embodiment and the dependency of the waveguide mode on the effective propagation angle (°) by a finite element method. FIG. 7 is a graph when the photon energy of the X-ray is 8 kilo-electron-volt. A waveguide mode 701 whose propagation loss is significantly smaller than that of other waveguide modes is the periodic resonant waveguide mode. FIG. 8 shows an electric field intensity distribution of the periodic resonant waveguide mode 701 in the laminating direction. Areas 801, 802, 803, 804, and 805 respectively correspond to the Si substrate portion, the multilayer film, an air portion, the lower cladding, and the upper cladding. Since the upper cladding and the lower cladding have a sufficient thickness of 20 nanometer, the periodic resonant waveguide mode is strongly confined in the core area. Therefore, it is found that there is no leakage into the Si substrate portion and the air portion.

Second Embodiment

Figure 9:
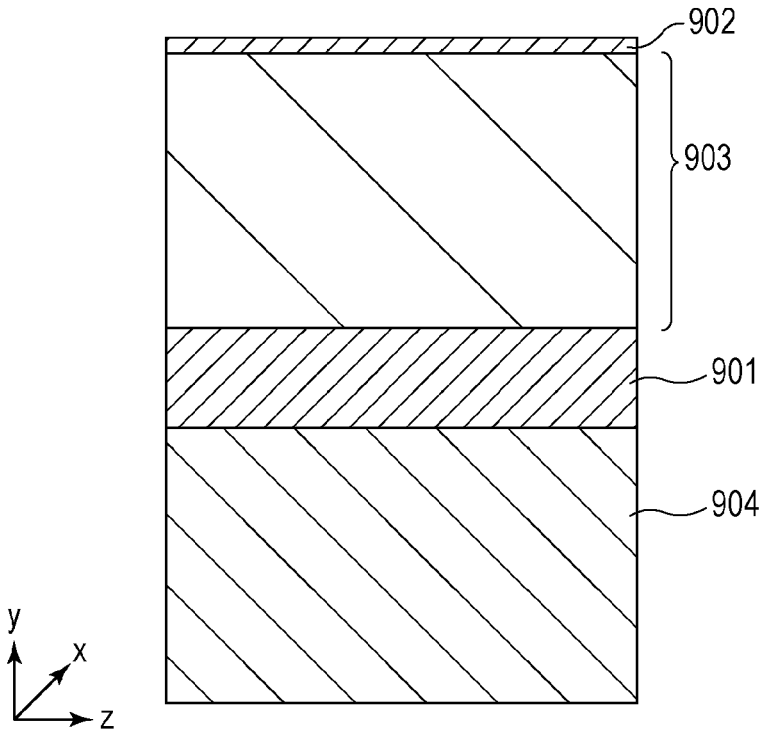
FIG. 9 is a diagram showing an X-ray waveguide of a second embodiment of the present invention.

FIG. 9 shows a form of an X-ray waveguide of a second embodiment of the present invention. The X-ray waveguide of the second embodiment is formed by a sputtering method in the same manner as in the first embodiment. On an Si substrate 904, a lower cladding 901 made of tungsten (W) having a thickness of 20 nanometer, a multilayer film 903 having a one-dimensional periodic structure to be a core, and an upper cladding 902 made of tungsten (W) having a thickness of 4 nanometer are formed.

The multilayer film 903 has a periodic structure in which a film made of carbon (C) having a thickness of 14.4 nanometer and a film made of aluminum oxide ($Al_2O_3$) having a thickness of 3.6 nanometer are alternately laminated. The number of the periods is 25 and the period is 18 nanometer. Actually, the uppermost portion and the lowermost portion of the core is made of a film of aluminum oxide ($Al_2O_3$) having a low real part of refractive index. The critical angle for total reflection at the interface between the cladding and the core for an X-ray having a photon energy of 8 kilo-electron-volt is about 0.51°. The critical angle for total reflection at the interface between the aluminum oxide and the carbon that form the periodic structure in the multilayer film is about 0.19°. The Bragg angle due to the periodicity of the multilayer film is about 0.25°. Therefore, the configuration satisfies the formulas (4) and (6).

Figure 10:
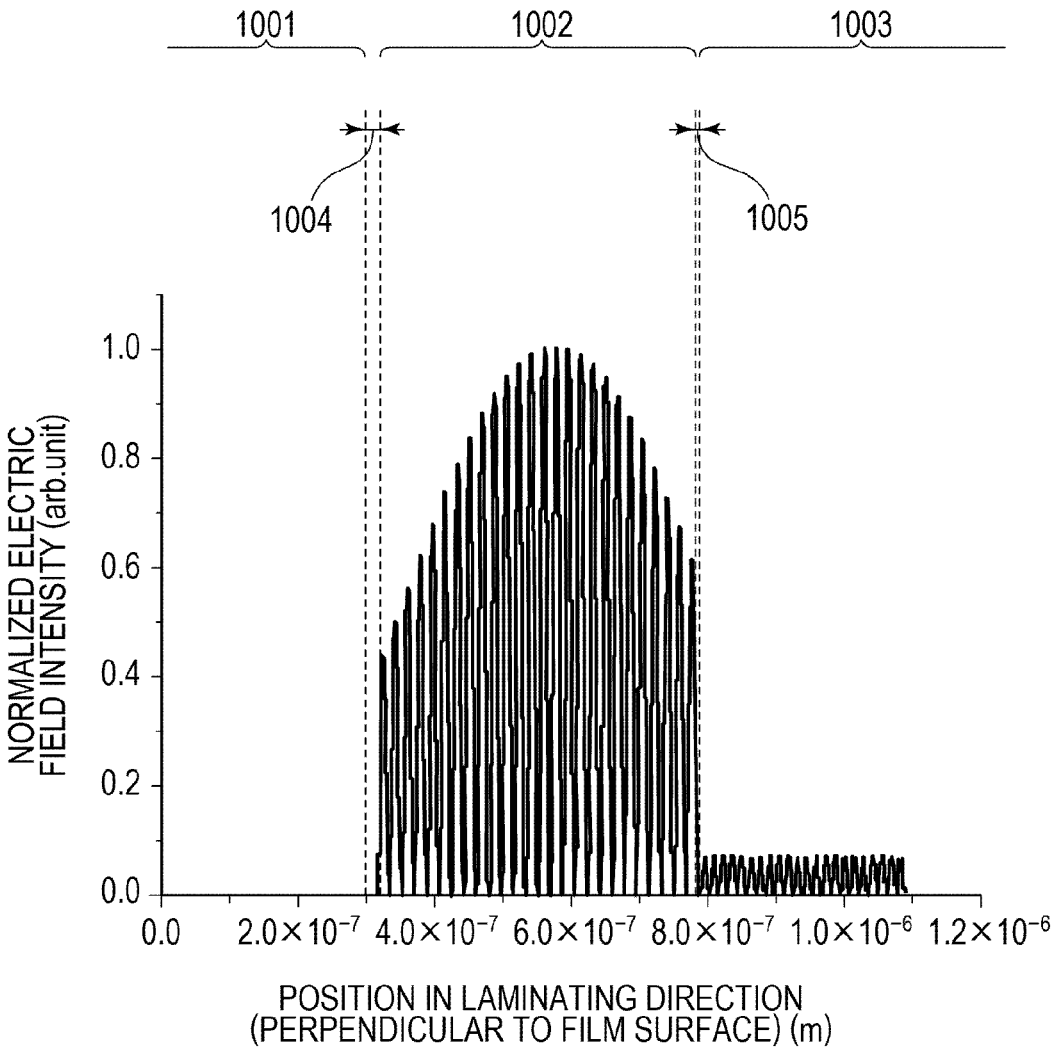
FIG. 10 is a diagram showing an electric field intensity distribution of periodic resonant waveguide mode in the X-ray waveguide of the second embodiment of the present invention.

FIG. 10 shows an electric field intensity distribution in the laminating direction of the periodic resonant waveguide mode 701 that can be present in the X-ray waveguide of the present embodiment. Areas 1001, 1002, 1003, 1004, and 1005 respectively correspond to the Si substrate portion, the multilayer film, an air portion, the lower cladding, and the upper cladding. FIG. 10 is a calculation result when the photon energy of the X-ray is 8 kilo-electron-volt. The calculation is performed assuming that the air area is a finite space for convenience of calculation.

Since the upper cladding 902 has a small thickness of 4 nanometer in the present embodiment, light leaks into the air portion 1003 in FIG. 10. Therefore, by inputting X-rays into the upper cladding at the effective propagation angle of the waveguide mode or at an angle near the effective propagation angle from the outside (air), the X-rays can be introduced into the core from the surface of the upper cladding 902 with evanescent wave coupling. Thereby X-rays can be guided by exciting only a specific periodic resonant waveguide mode.

Third Embodiment

Figure 11:
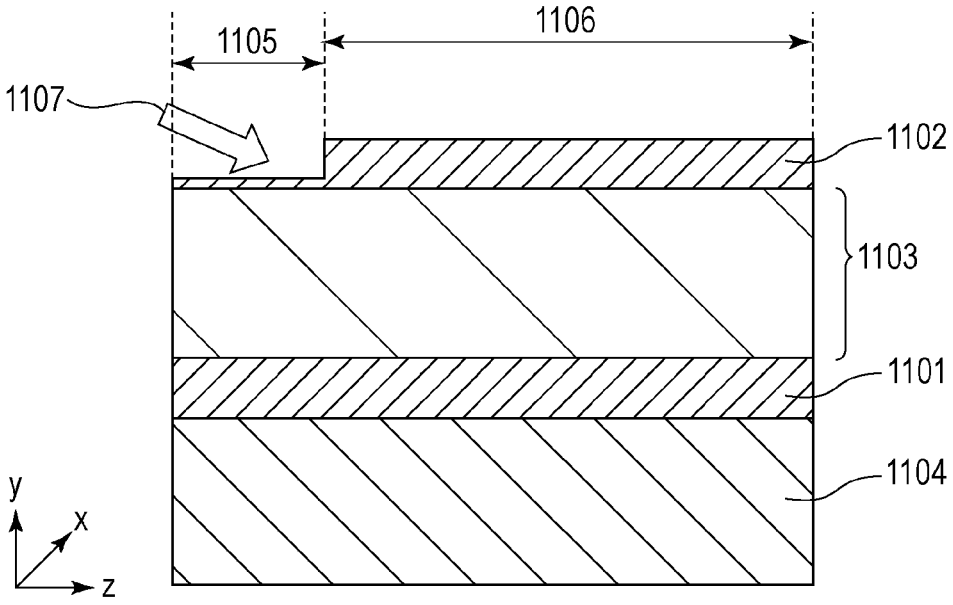
FIG. 11 is a diagram showing an X-ray waveguide of a third embodiment of the present invention.

FIG. 11 shows a form of an X-ray waveguide of a third embodiment of the present invention. On a Si substrate 1104, a lower cladding 1101 made of tungsten (W) having a thickness of 20 nanometer is formed by a sputtering method. Further, a multilayer film 1103 having a one-dimensional periodic structure to be a core and an upper cladding 1102 made of tungsten (W) are formed. The upper cladding 1102 is formed to have a two-step thickness along the guiding direction of X-rays. The thickness of the upper cladding is 1.5 nanometer in the area 1105 and 20 nanometer in the area 1106. A part of X-rays 1107 incident onto the surface of the upper cladding 1102 in the area 1105 at a specific angle is coupled to the periodic resonant waveguide mode in the multilayer film 1103, and the periodic resonant waveguide mode is excited in the core to guide the X-rays.

The length of the area 1105 is about 3 mm in the z direction. In this area, the incident X-rays are coupled to the waveguide mode in the core, and X-rays of the waveguide mode in the core gradually leak to the outside of the upper cladding 1102. However, the excited periodic resonant waveguide mode is completely confined in the core by the upper cladding having a sufficient thickness in the area 1106. Thereby it is possible to cause the periodic resonant waveguide mode to contribute to the propagation without leaking the X-ray of periodic resonant waveguide mode to the outside of the upper cladding 1102.

The multilayer film 1103, which is the core, is a multilayer film having a one-dimensional periodic structure in which a film made of boron carbide ($B_4C$) having a thickness of 12 nanometer and a film made of aluminum oxide ($Al_2O_3$) having a thickness of 3 nanometer are alternately laminated. Films forming the upper end portion and the lower end portion of the multilayer film are made of boron carbide ($B_4C$) having a high real part of refractive index. The number of the periods is 100 and the period is 15 nanometer.

When the photon energy of the X-ray is 10 kilo-electron-volt, the effective propagation angle of the periodic resonant waveguide mode excited in the X-ray waveguide of the present embodiment is about 0.3°. The critical angle for total reflection at the interface between the cladding and the core for an X-ray having a photon energy of 10 kilo-electron-volt is about 0.39°. The critical angle for total reflection at the interface between the aluminum oxide and the boron carbide that form an unit structure in the multilayer film is about 0.09°. The Bragg angle due to the periodicity of the multilayer film is about 0.3°. Therefore, the configuration satisfies the formulas (4) and (6).

Figure 12A:
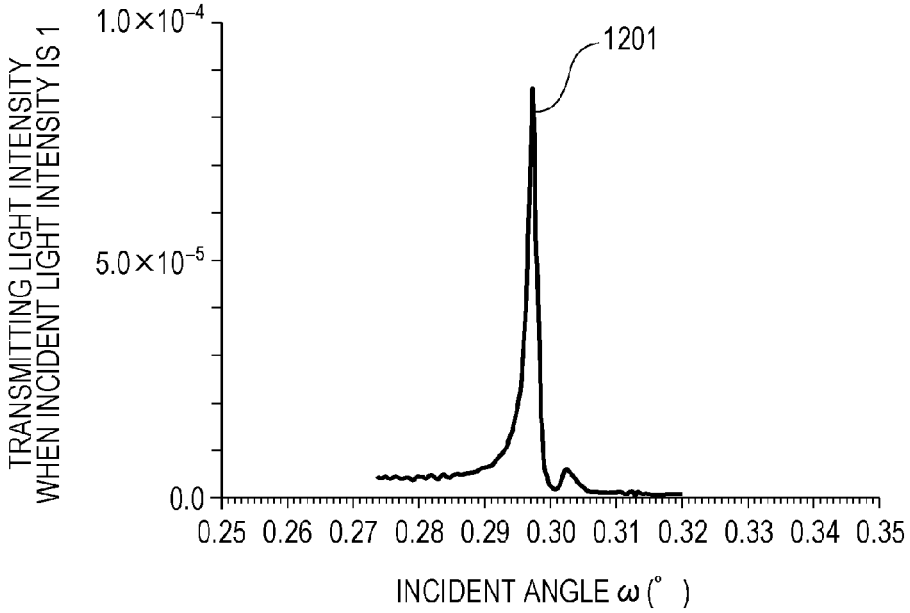
FIGS. 12A and 12B respectively show an experimental result and a calculation result of the third embodiment of the present invention.
Figure 12B:
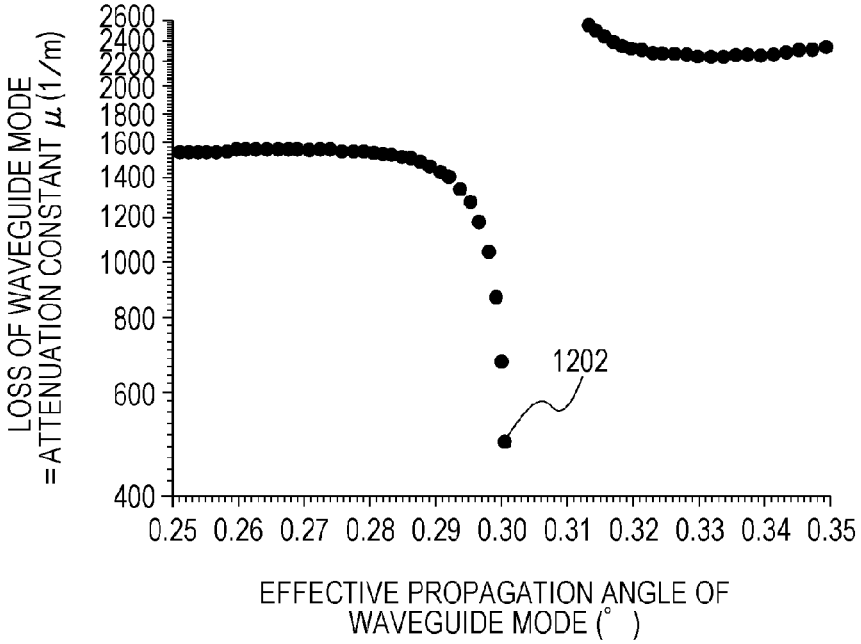

FIG. 12A shows a result of experiment in which X-rays are incident from a portion where the upper cladding is thin in the X-ray waveguide of the present embodiment while changing the incident angle and X-rays which are guided in the core of the waveguide and outputted X-rays are detected. The vertical axis indicates the ratio of the intensity of the guided X-rays to the intensity of the inputted X-rays. The incident angle is measured from the surface of the waveguide. When the incident angle substantially corresponds to the effective propagation angle of the waveguide mode, the waveguide mode is excited in the core and X-rays can be guided. In particular, in FIG. 12A, the waveguide mode corresponding to the sharp peak denoted by reference numeral 1201 is caused by the periodic resonant waveguide mode, and the propagation loss of this waveguide mode is significantly smaller than that of other modes. FIG. 12B is a graph in which the propagation loss of the waveguide mode in the X-ray waveguide of the present embodiment is plotted with the vertical axis representing one obtained by a finite element method using an attenuation constant μ (1/m) and the horizontal axis representing an effective propagation angle of each waveguide mode. In FIG. 12B, the point denoted by reference numeral 1202 corresponds to the propagation loss and the effective propagation angle of the periodic resonant waveguide mode, and the fact that this waveguide mode has a propagation loss extremely smaller than that of other waveguide modes matches the experiment. The effective propagation angle of the periodic resonant waveguide mode matches the incident angle when the periodic resonant waveguide mode is excited by the experiment, so that it is found that a substantially single waveguide mode with a small loss can be formed by the configuration of the X-ray waveguide of the present invention. Further, it is observed that the X-rays outputted from the X-ray waveguide forms a sharp pattern in a specific direction in far-field region, which means that divergence angle of the outputted X-ray in the far-field region is extremely small. Thereby it is also confirmed that the periodic resonant waveguide mode is in phase in near-field region.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-196522, filed Sep. 2, 2010, which is hereby incorporated by reference herein in its entirety.

INDUSTRIAL APPLICABILITY

The X-ray waveguide of the present invention can be used in X-ray optical technique field. In particular, the X-ray waveguide can be used for components employed in an X-ray optical system for operating X-rays outputted from a synchrotron, an X-ray imaging technique, and an X-ray exposure technique.

REFERENCE SIGNS LIST

101 core
102 cladding
103 cladding
104 unit structure
105 layer of material having high real part of refractive index
106 layer of material having low real part of refractive index
107 critical angle for total reflection
108 Bragg angle
109 critical angle for total reflection
301 cladding
302 cladding
303 core
401 point representing loss of periodic resonant waveguide mode
402 angle area representing photonic band gap (Bragg reflection)
403 angle area where waveguide mode can be present
404 angle area where waveguide mode cannot be present (becomes radiation mode)
501 area of cladding
502 area of cladding
503 area of core

The invention claimed is:

1. A X-ray waveguide comprising:

a core configured to guide X-rays having a wavelength band in which the real part of refractive index of material is smaller than 1; and a cladding configured to confine the X-rays in the core, wherein the core has a one-dimensional periodic structure in which a plurality of layers respectively formed of inorganic materials having different real parts of refractive indices are periodically laminated, the core and the cladding are configured so that a critical angle for total reflection for the X-rays at an interface between the core and the cladding is larger than a Bragg angle due to a periodicity of the one-dimensional periodic structure, and a critical angle for total reflection for the X-rays at an interface between layers in the one-dimensional periodic structure is smaller than the Bragg angle due to the periodicity of the one-dimensional periodic structure.

2. The X-ray waveguide according to claim 1, wherein the number of periods in the periodic structure is greater than or equal to 20.

3. The X-ray waveguide according to claim 1, wherein the inorganic materials, which form the core and have different real parts of refractive index, are at least two types of materials selected from the group consisting of Be, B, C, $B_4C$, BN, SiC, $Si_3N_4$, SiN, $Al_2O_3$, MgO, $TiO_2$, $SiO_2$, and P.

4. The X-ray waveguide according to claim 1, wherein a material forming the cladding are at least one type of material selected from the group consisting of Au, W, Ta, Pt, Ir, and Os.

* * * * *